US006269950B1

(12) United States Patent
Nguyen

(10) Patent No.: US 6,269,950 B1
(45) **Date of Patent: *Aug. 7, 2001**

(54) TAB-FREE THERMOPLASTIC T-SHIRT BAG SYSTEM

(76) Inventor: Tai H. Nguyen, 83 Monterrey Dr., Kenner, LA (US) 70065

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/189,854

(22) Filed: Nov. 10, 1998

Related U.S. Application Data

(63) Continuation-in-part of application No. 08/717,083, filed on Oct. 7, 1996, now Pat. No. 5,863,130, which is a continuation-in-part of application No. 08/337,167, filed on Nov. 10, 1994, now Pat. No. 5,561,967, which is a continuation-in-part of application No. 08/124,278, filed on Sep. 20, 1993, now Pat. No. 5,363,965.

(51) Int. Cl.[7] ..... B65D 33/14
(52) U.S. Cl. ..... 206/554; 383/9
(58) Field of Search ..... 206/554, 390; 383/7–9, 37

(56) References Cited

U.S. PATENT DOCUMENTS 4,529,090 * 7/1985 Pilon ..... 206/554
4,796,759 * 1/1989 Schisler ..... 206/554
5,074,674 * 12/1991 Kuklies et al. ..... 383/8
5,188,235 * 2/1993 Pierce et al. ..... 206/554
5,207,328 * 5/1993 Bose et al. ..... 206/554
5,346,310 * 9/1994 Nguyen ..... 383/9
5,363,965 * 11/1994 Nguyen ..... 206/554
5,465,846 * 11/1995 Blyth et al. ..... 206/554
5,695,064 * 12/1997 Huang et al. ..... 206/554
5,845,779 * 12/1998 Wilfong, Jr. et al. ..... 206/554

* cited by examiner

*Primary Examiner*—Jim Foster
(74) *Attorney, Agent, or Firm*—Joseph T. Regard, Ltd.

(57) ABSTRACT

A bag and system for dispensing thermoplastic bags or the like from a stack of bags. The preferred, exemplary embodiment of the present system teaches a configuration which minimizes the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems. Further, the bag of the present invention also contemplates a non-removable central mouth support raised area, wherein there is provided a support cut configured to accept a rack central support piece, the cut configured to provide maximum ease in separation of the dispensed bag from the pack, with clean separation of the area above the support cut of the pack, thereby preventing tearing of the bag upon dispensing. Situated in spaced relationship above the medial portion of support cut is a dispense cut formed between the upper edge of the raised area formed in the bag mouth area of the bag, the dispense cut configured to facilitate removal of the bag from a bag rack support piece, dispensing an individual bag from a pack of bags, while not affecting the support strength of the support cut in its operation of retaining the stack of bags upon the bag rack.

4 Claims, 8 Drawing Sheets

30
8
31
3
9
34
14
23
10
17
11
6
27
33
15
16
28
7
22
26
18
25
24
5
32
12
B
13
1
2
4

37
14
23"
15
16
33
47
32'
26

41
43
42
14
40
15
16
33
44
32
26

TAB-FREE THERMOPLASTIC T-SHIRT BAG SYSTEM

STATEMENT OF CONTINUING APPLICATIONS

The present application is a continuation-in-part of U.S. patent application Ser. No. 08/717,083, filed Oct. 07, 1996, issued as U.S. Pat. No. 5,863,130, which application is a continuation-in-part of U.S. patent application Ser. No. 08/337,167, filed Nov. 10, 1994, issuing as U.S. Pat. No. 5,561,967, which application is a continuation-in-part of U.S. patent application Ser. No. 08/124,278, filed Sep. 20, 1993, which issued as U.S. Pat. No. 5,363,965.

TECHNICAL FIELD OF THE INVENTION

The present invention relates to bag dispensing systems, and particularly to a bag and system for dispensing thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like.

The preferred, exemplary embodiment of the present system teaches a configuration which minimizes the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems.

Further, the bag of the present invention also contemplates a unique, non-removable central mouth support piece, wherein there is provided a support cut configured tp accept a rack central support piece, the cut configured to provide maximum ease in separation of the dispensed bag from the pack, with clean separation of the area above the support cut of the pack, thereby preventing tearing of the bag upon dispensing.

BACKGROUND OF THE INVENTION

Although thermoplastic grocery bags have been utilized for over twenty years, only a very small percentage of the hundreds of patents have been embraced by industry to the point of significant commercial acceptance. Designing a thermoplastic bag, particularly with regard low or high density thermoplastic bags, can be a tedious and often unfruitful endeavor, as such material requires a design which allows its utilization as a bag for often heavy contents, which can cause stress fractures and bag failure. Further, the design should be able to be manufactured in an inexpensive, efficient, and consistent manner.

A list of prior patents which may be of interest is presented below:

| Patent No. | Inventor(s) | Issue Date |
|---|---|---|
| RE 33,264 | Baxley et al. | 06/17/1990 |
| 4,476,979 | Reimann et al | 10/16/1984 |
| 4,785,938 | Benoit, Jr. et al | 11/22/1988 |
| 4,811,417 | Prince et al | 03/07/1989 |
| 4,989,732 | Smith | 02/05/1991 |

-continued

| Patent No. | Inventor(s) | Issue Date |
|---|---|---|
| 5,074,674 | Kulkies et al | 12/24/1991 |
| 5,188,235 | Pierce et al | 02/23/1993 |

U.S. Pat. No. 5,074,674 to Kuklies et al teaches a bag comprising front and rear bag walls, the rear wall of the bag including an aperture centrally disposed between the handles and below the open top for reception by a retainer for supporting only the rear wall of the bag on the rack. The rear wall of the bag may have formed between the aperture and the bag mouth a "tear area" facilitated by a "preperforated line" (col 2, lines 36–40), which is indicated as not being required.

U.S. Pat. No. 5,188,235 to Pierce et al teaches a bag pack system for dispensing T-Shirt bags without the necessity of a detachable tab, claiming a "weakened portion comprising a severance line", contemplated in the specification as a vertical perforation extending between a generally horizontal central mounting aperture and a bag mouth. Thus, '235 requires the deliberate weakening of a linear portion of the bag structure above the mounting aperture to facilitate operation.

U.S. Pat. No. Re. 33,264 teaches a system wherein there is a detachable tab, unlike the present "tabless" system.

GENERAL SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

The preferred, exemplary embodiment of the present system teaches a configuration which minimizes the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems.

Further, the bag of the present invention also contemplates a unique, non-removable central mouth support piece, wherein there is provided a support cut configured tp accept a rack central support piece, the cut configured to provide maximum ease in separation of the dispensed bag from the pack, with clean separation of the area above the support cut of the pack thereby preventing tearing of the bag upon dispensing.

Situated in spaced relationship above the medial portion of support cut is a dispense cut formed between the upper edge of the raised area formed in the bag mouth area of the bag, the dispense cut configured to facilitate removal of the bag from a bag rack support piece, dispensing an individual bag from a pack of bags, while not affecting the support strength of the support cut in its operation of retaining the stack of bags upon the bag rack.

It is therefore an object of the present invention to provide an improved system for dispensing individual thermoplastic bags or the like.

It is another object of the present invention to provide a non-detachable tab having a support cut configured for accepting the rack support piece in such a fashion as to prevent crimping or folding.

It is still another object of the present invention to provide a bag dispensing system which requires little significant equipment modification, while providing a consistent quality, strong and aesthetically acceptable product.

Lastly, it is an object of the present invention to provide a bag pack which is easily loaded upon a rack, and once dispensed, leaves no residual tabs or pieces thereon.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
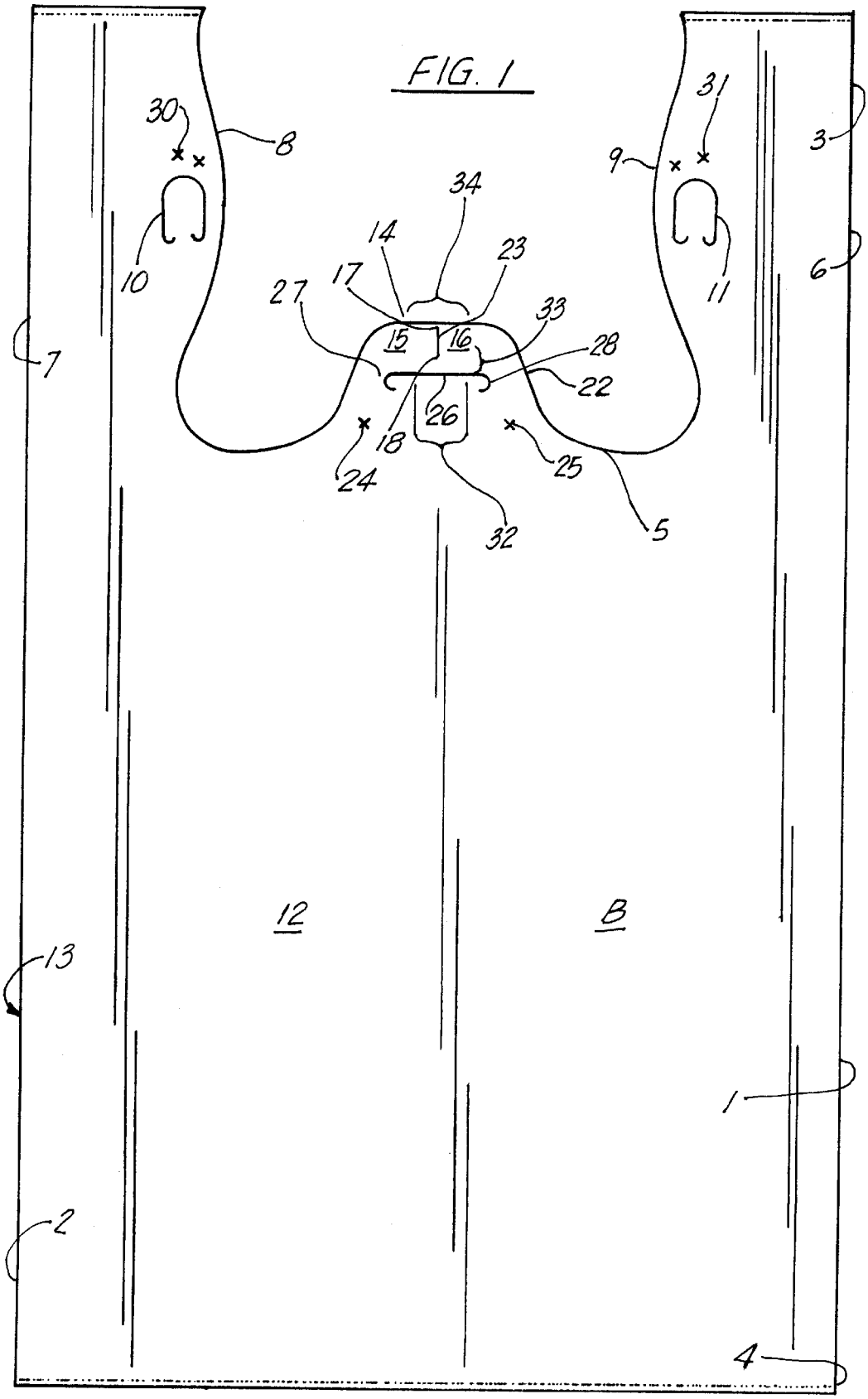
FIG. 1 is a front view of the preferred configuration of the self-opening, tab-free thermoplastic bag of the present invention.

As can be seen in FIG. 1, the bag B of the preferred, exemplary embodiment of the present invention, comprises first 12 and second 13 bag walls joined at first 1 and second 2 sides (which may be gusseted), a bottom 3 and top 4 ends, and a mouth 5. Emanating from opposing ends of the mouth 5 are first 7 and second 6 handles emanating therefrom, each handle having an inner side edge 8, 9, respectively. Further included in the handles 7, 6, are first and second handle support cuts or apertures 10, 11, respectively. The handle support cuts may be formed via cutting die or the like pressed upon and through the bag.

Figure 3:
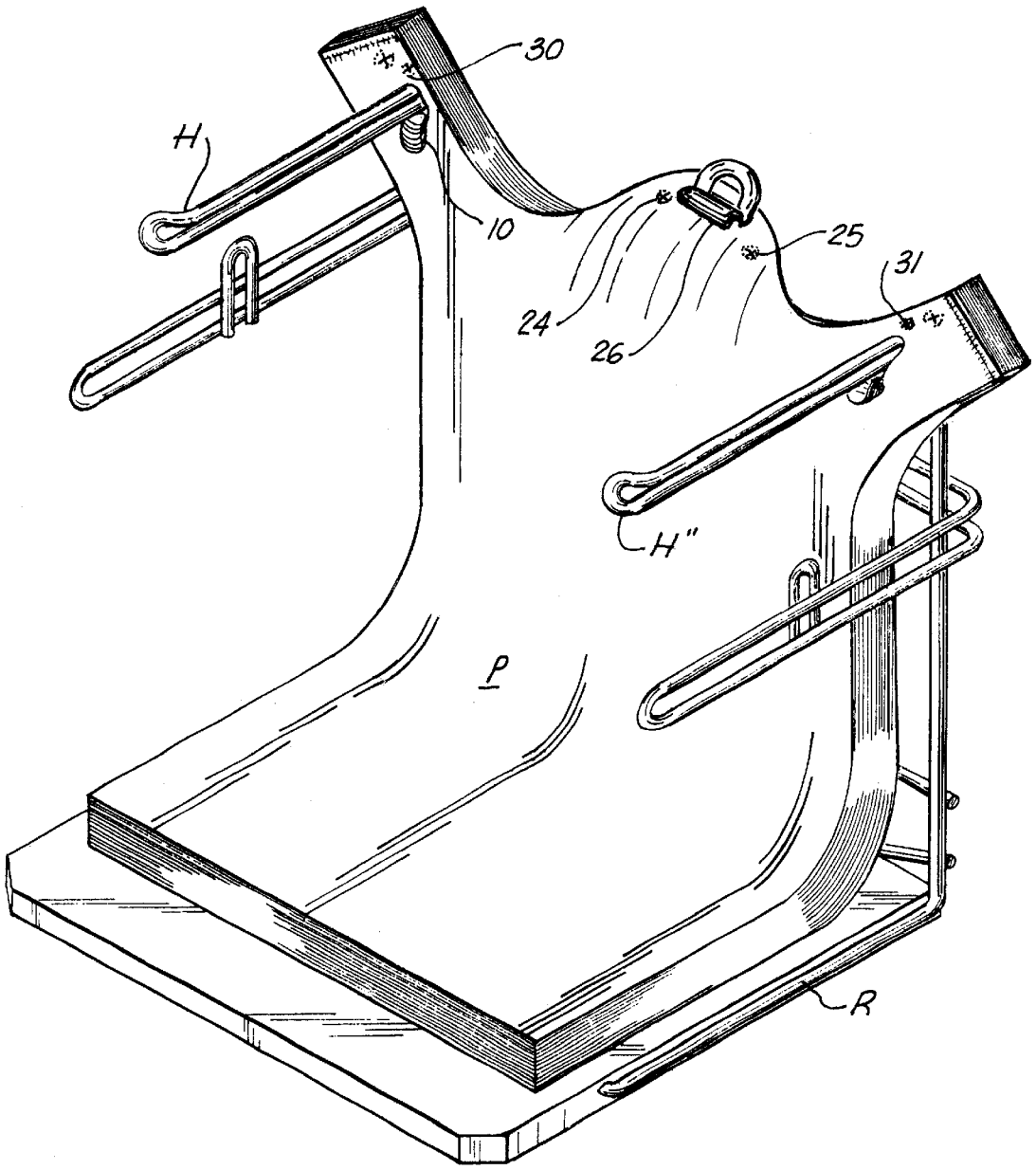
FIG. 3 is an isometric view of the bag pack of the present invention mounted upon an exemplary bag rack.

Emanating from the bag mouth 5 is raised area 22, having first and second punches 24, 25 situated therein, with further punches 30, 31 situated adjacent to handle support cuts 10, 11, respectively, all of the punches 24, 25, 30, 31 configured to retain a stack of bags to form and retain same as a bag pack, as illustrated in FIG. 3. Continuing with FIG. 1, formed and situated at a generally horizontal position within the raised area 22 is a support cut 26 having first 27 and second 28 ends, which may be turned downward and inward to prevent fracturing of the material.

The punches 24, 25, 30, or 31 may vary in configuration as a cross configuration (+), asterisk (*), an "x" (×) or other configuration provided by a least first and second cuts intersecting medially, or, in the case of a star or asterisk or the like, providing a multiple cuts of generally like length intersecting medially at a central point, the punches penetrating the first and second bag walls of the bags of preferably each bag in the bag pack, to retain same into a pack in a releasable, dispensable fashion. Further disclosure on the above punch configuration may be found in U.S. Pat. Ser. No. 08/717,083 to Nguyen, the specification, drawings, and claims of which are incorporated herein by reference, as well as U.S. Pat. No. 5,561,967 issued Oct. 08, 1994, and U.S. Pat. No. 5,363,965 issued Nov. 15, 1994, also to Nguyen.

Formed in a medial area 34 of the bag mouth 22, from the upper medial portion and towards support cut 22 is a laterally situated (relative to the support cut) dispense cut 23 through the first 12 and second 13 walls forming the bag, the cut having first and second ends, the first end 18 cutting a portion of the edge 14 of the bag forming the bag mouth, separating same into first 15 and second 16 portions, the second end 17 of the dispense cut 23 terminating in spaced 33 fashion (about 0.05 inches–0.33 inches, depending upon the material, gauge, method of manufacture, etc) from the upper medial portion 32 of support cut 26.

Figure 2A:
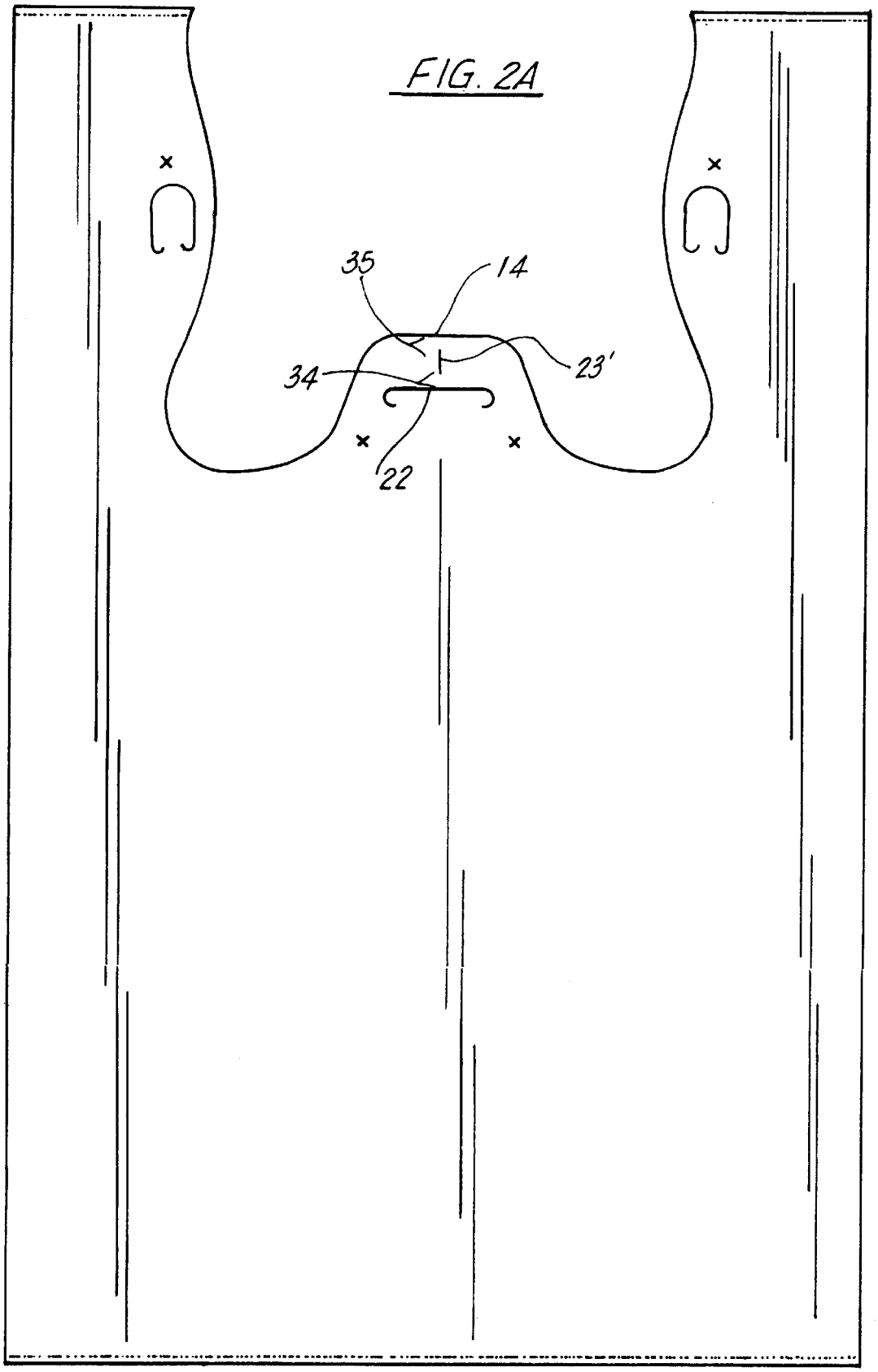
FIGS. 2A–2C are front views of alternative embodiments of the self-opening, tab-free thermoplastic bag of FIG. 1, having a medial slit situated between the top of the bag mouth and the support aperture.
Figure 2B:
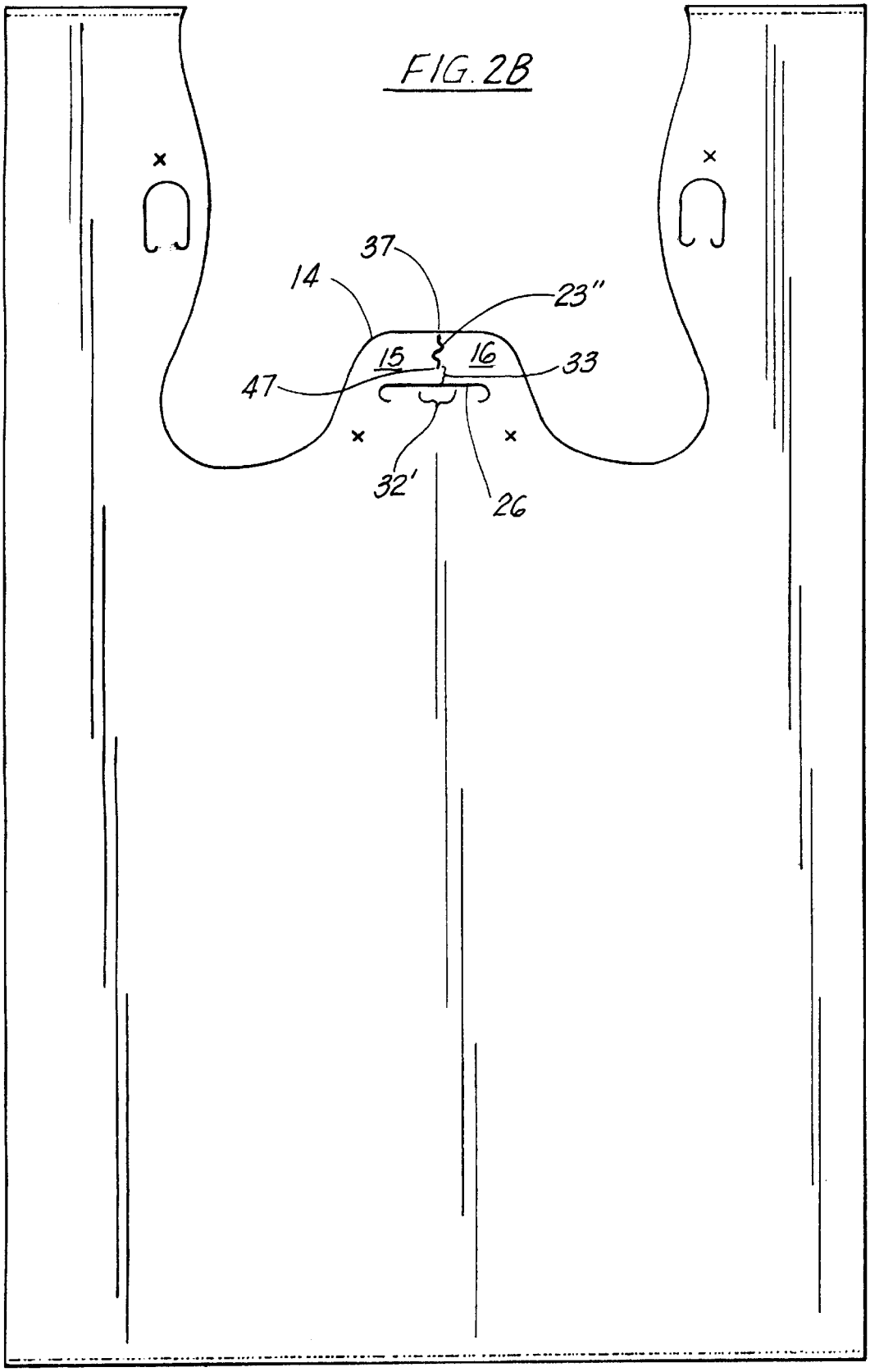
Figure 2C:
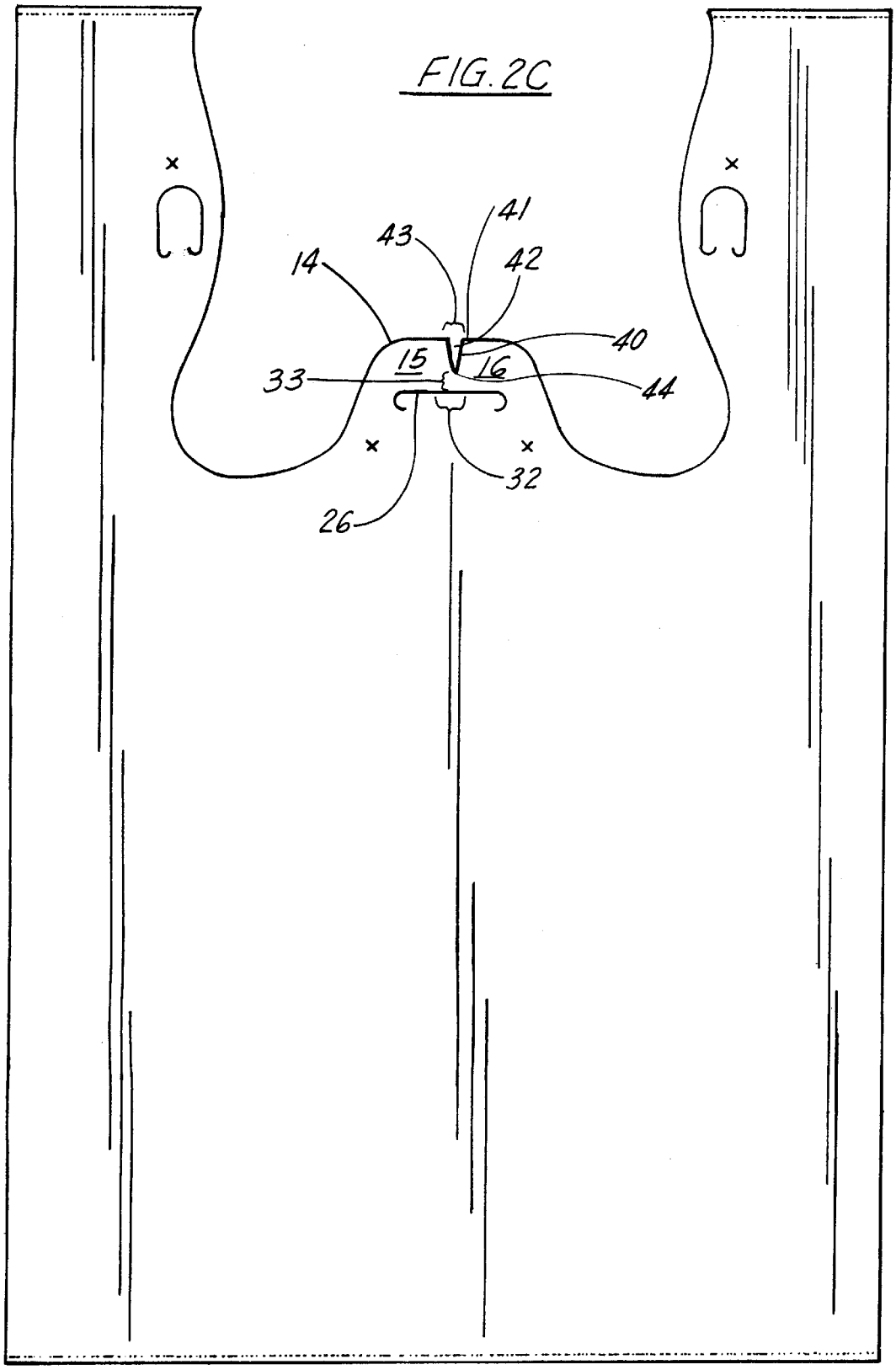

FIGS. 2A–2C illustrate alternative configurations of the dispense cut, which may vary, as will be shown; FIG. 2A illustrates a dispense cut 23' spaced in medial fashion above the handle support cut 22, spaced 34, 35 from support cut 22 and the edge 14 forming the bag mouth 5, respectively, the spaced areas 34, 35 being about 0.05–0.33 inches.

FIG. 2B illustrates an alternative dispense cut 23" like the dispense cut (23 in FIG. 2), dispense cut 23" comprising a curved cut (as illustrated comprising a generally vertical first end the first end 37 cutting a portion of the edge 14 of the bag forming the bag mouth, separating same into first 15 and second 16 portions, the second end 47 of the dispense cut 23" terminating in spaced 33 fashion (about 0.05 inches–0.33 inches, depending upon the material, gauge, method of manufacture, etc) from the upper medial portion 32 of support cut 26.

FIG. 2C illustrates an third alternative dispense cut 40, having first 41 and second 44 ends, with an open area 42 therebetween, the width 43 of the open area being wider at the top 41 end than the second, bottom 44 end (the second end shown terminating in a point directed towards, but spaced from, the support cut), the cut emanating from the edge 14 of the bag forming the bag mouth, separating same into first 15 and second 16 portions, the second end 44 of the dispense cut 40 terminating in spaced 33 fashion (about 0.05 inches–0.33 inches, depending upon the material, gauge, method of manufacture, etc) from the upper medial portion 32 of support cut 26. It is noted that, while the dispense cut 40 is shown having linear edges, radial edges would also likely work as well.

Referring to FIG. 3 of the drawings, the individual bags of the present invention are held together in a bag pack P via the utilization of the above disclosed punches 24, 25 in the raised portion and punches 30, 31 in the handles, in the preferred embodiment, formed in the vicinity of the upper end of the handles and handle apertures 10, 11 respectively.

As further shown, the bag pack of the present invention may be dispensed upon a rack R having first and second, somewhat horizontally situated handle support members H', H", and a support member T, configured to communicate with handle apertures 10, 11 and support cut 26, respectively.

Figure 4A:
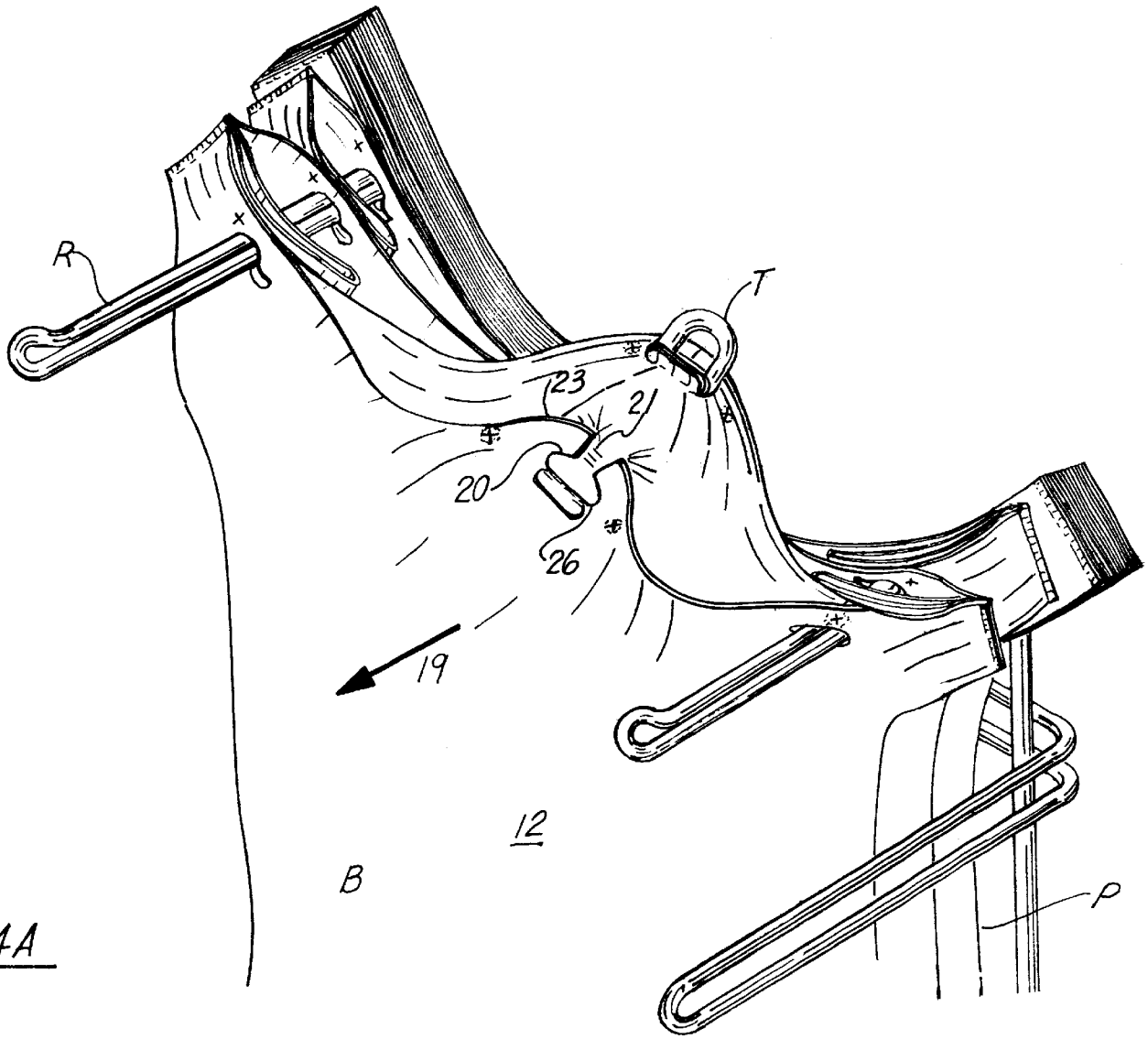
FIGS. 4A–4C are isometric views of a user opening the next bag to be dispensed upon a rack, illustrating the removal of the bag from the bag pack.

Continuing with FIG. 4A, in use, the user simply loads a pack P of bags upon the rack R as shown, and dispenses the first bag in the stack by pulling the front wall 12 of the bag B to be dispensed, and pulling same to apply applying light pressure 19 to the upper, medial portion of the mouth of the bag, applying pressure to the upper medial edge 20 of the support cut 26 so as to cause the thermoplastic forming said edge to rupture 21 at the space between said edge and the second, bottom tip of the dispense cut, said rupture communicating with the dispense cut 23, releasing the bag from the support tab T and associated bag wall from the pack P, the user, by continuing to pull 19 the dispensed bag wall toward him, separates the first wall 12 of the bag B in opened position for loading, while leaving the other bag wall retained with the pack on the rack.

Figure 4B:
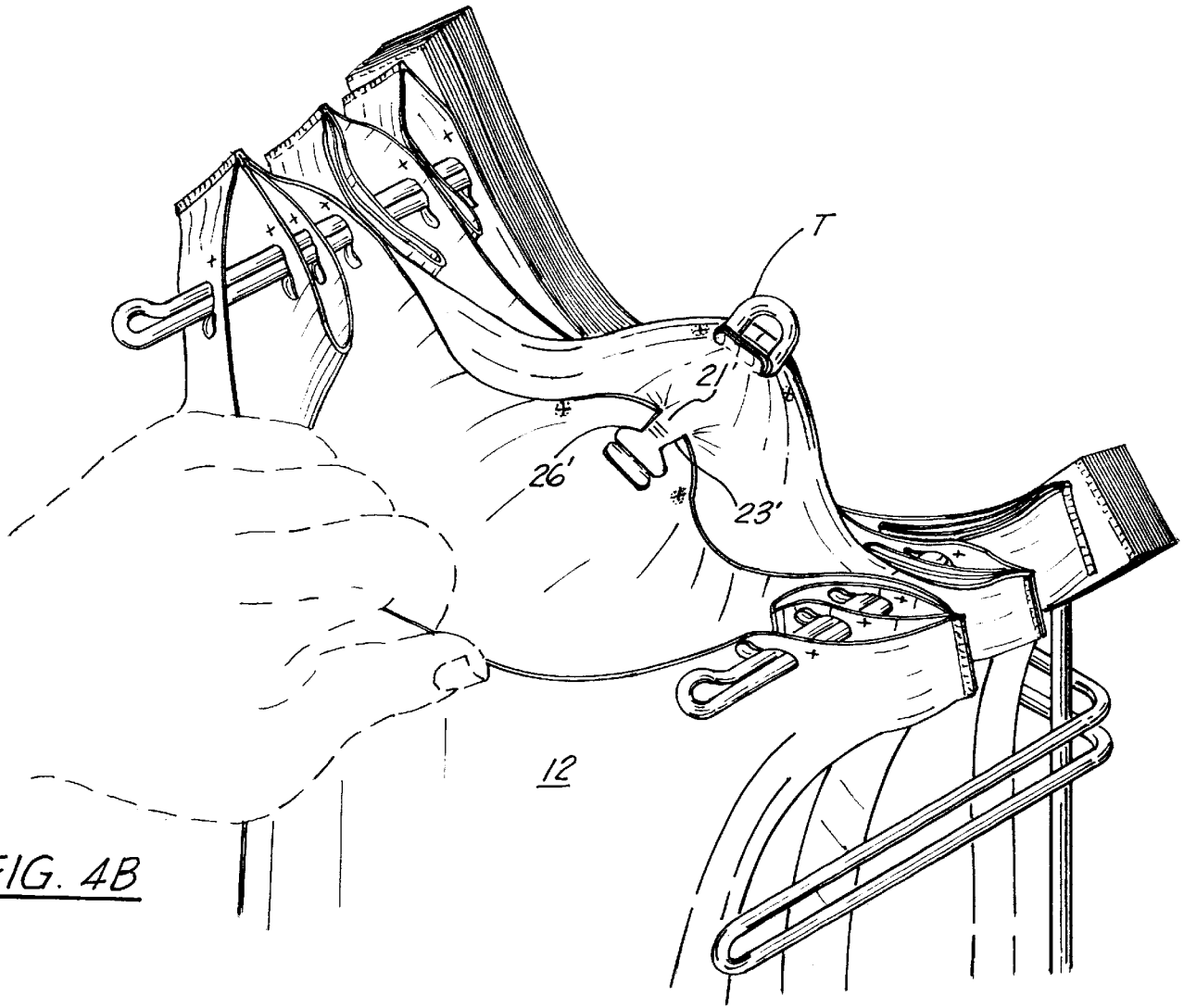

Referring to FIG. 4B, upon loading of the bag, the first wall 12 is grasped and pulled away from the bag pack and rack to remove the loaded bag from the rack. As the bag continues to be pulled toward the user, the support cut 26' for the second, back wall 13, still engaged to the tab support member T, ruptures 21' between the support cut and generally laterally disposed cut 23' causing the higher, thereby completing the dispensing operation.

Figure 4C:
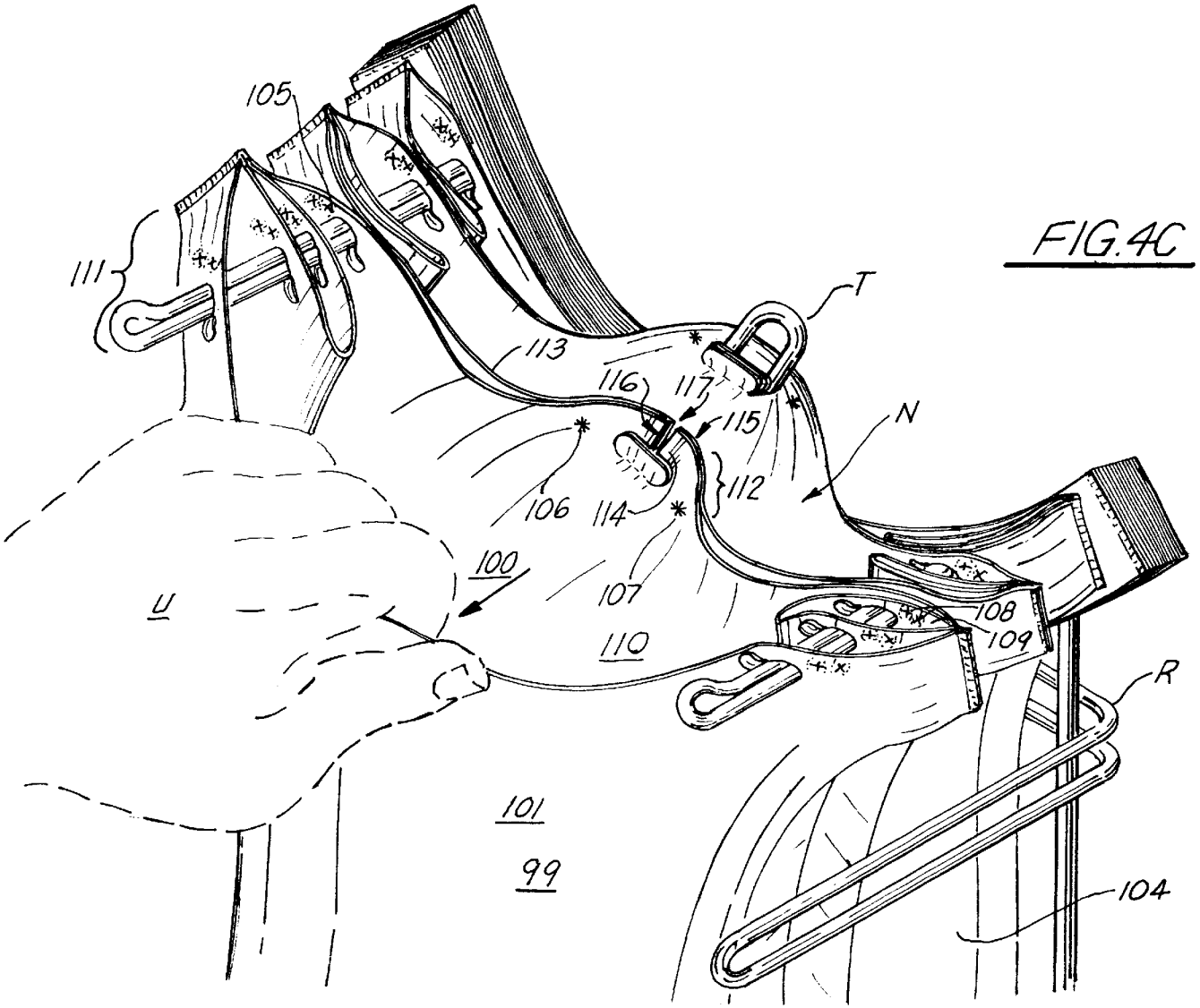

FIG. 4C illustrates the present invention utilizing the self-opening thermoplastic bag teachings of U.S. Pat. Ser. Nos. 08/717,083 to Nguyen, as well as U.S. Pat. No. 5,561,967 issued Oct. 08, 1994, and U.S. Pat. No. 5,363,965 issued Nov. 15, 1994, also to Nguyen, the specifications and teachings of all of which are incorporated herein by reference.

As shown, the user U pulls the first, front wall 99 of the lead bag 101 from the rack R. In doing so, the handle apertures 102, 103 of the front wall ride along the handle support rods H, H' away from the bag pack 104, however, the punches 105, 106, 107, 108, 109 formed in the second, rear bag wall 110 cause the handle area 11 1 and raised area 112 of the rear wall of the lead bag to adhere to the front wall 113 of the next bag N sufficient hold the second, rear bag wall to remain adjacent to the pack 104, allowing the front wall 99 of the lead bag to be held in an open position for loading goods therein.

The punches permeate the walls of the bags such that the rear wall of the next bag N remains with the pack, and supported by tab support member T. Once loaded, as the lead bag is removed from the rack, the second, rear wall 110 of the of said lead bag engages via the punches 105, 106, 107, 108 the front wall of the next bag, applying pulling force to same to rupture dispense cuts 114, 115 into dispense cuts, respectively, freeing said walls from the tab support member T. As the lead bag is removed, the front wall 13 of the next bag N to be dispensed is pulled into an open position on the rack, separating from the rear wall of the lead bag, leaving the next bag in open position on the rack, ready to be loaded.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A thermoplastic bag having first and second sides and bottom and top ends, said bag comprising:

a bag mouth having opposing ends and a medial area, said medial area of said bag mouth being raised above said opposing ends of said bag mouth, forming a raised medial area having a top edge, said raised medial area further having formed therein a generally horizontally situated support cut having first and second ends, said raised medial area further having a dispense cut situated in spaced, generally lateral fashion relative to said support cut;

first and second handles emanating from said bag mouth, each of said handles having an upper end, a lower end, an inner side edge, and a medial area therebetween; said first and second handles having first and second punch stamps formed therein, respectively;

said first and second punch stamps comprising first and second, generally linear cut sections formed in said bag, said first and second linear cut sections penetrating said handles.

2. The thermoplastic bag of claim 1, wherein said dispense cut has first and second ends, said first end situated at said top edge of said raised medial area, said second end situated in spaced fashion above said dispense cut.

3. The thermoplastic bag of claim 2, wherein said thermoplastic bag has a longitudinal axis, and said dispense cut formed in said raised medial area is generally aligned with said longitudinal axis of said thermoplastic bag.

4. The thermoplastic bag of claim 3, wherein said second end of said dispense cut formed in said raised medial area is spaced between 0.05–0.33 inches above said support cut formed in said raised medial area.

* * * * *